United States Patent [19]

Brecher

[11] 4,366,758

[45] Jan. 4, 1983

[54] TABLE TOP HOLD-DOWN AND CONNECTING BRACKET

[75] Inventor: Stanley A. Brecher, 520 Arnold St., Philadelphia, Pa. 19111

[73] Assignee: Stanley A. Brecher, Andalusia, Pa.

[21] Appl. No.: 238,156

[22] Filed: Mar. 2, 1981

[51] Int. Cl.[3] ..... A47B 57/00

[52] U.S. Cl. ..... 108/64; 108/114; 108/155

[58] Field of Search ..... 108/64, 114, 154, 155, 108/158

[56] References Cited

U.S. PATENT DOCUMENTS

| | | | |
|---|---|---|---|
| 1,581,257 | 4/1926 | Wege | 108/158 |
| 2,403,338 | 7/1946 | Butler | 108/64 |
| 2,714,540 | 8/1955 | Diehm | 108/155 |
| 2,731,316 | 1/1956 | Cohen | 108/114 X |
| 2,905,334 | 9/1959 | Gottschalk et al. | 108/64 X |
| 3,001,844 | 9/1961 | Spring | 108/64 X |

*Primary Examiner*—Francis K. Zugel

*Attorney, Agent, or Firm*—Weiser, Stapler & Spivak

[57] ABSTRACT

A bracket for interconnecting modular units of an endless table construction which includes a cooperating pair of brackets which are joined together below a transverse, structural channel in a manner to secure adjacent ends of table tops which are supported above the channel. Each brace forming the composite bracket includes an opening to receive therein a table top fastener in a removable manner. Each brace additionally is provided with a threaded opening within which a channel contacting stabilizer is adjustably positioned to provide a sturdy table top hold-down construction. The table top is drilled to provide openings aligned over the bracket openings to receive the table top fasteners therethrough. Preferably, the table top openings are countersunk at both ends to allow either table top surface to be positioned upwardly.

15 Claims, 5 Drawing Figures

TABLE TOP HOLD-DOWN AND CONNECTING BRACKET

BACKGROUND OF THE INVENTION

The present invention relates generally to the field of work tables, and more particularly, is directed to endless table constructions comprising a plurality of modular units which are joined together in end to end juxtaposition.

It is the common practice to utilize large work tables for numerous industries which provide a sturdy work surface at a convenient height to allow employees to effectively carry out their assigned tasks. In the garment manufacturing industry, for example, it is usual to provide such large work tables for cutters to layout many thicknesses of cloth for simultaneous cutting into the desired pattern. Considerable economy in time and expense can thereby be achieved over what would be normally expected if each layer of cloth had to be individually patterned and cut. Such tables are presently provided in various widths, for example in six inch increments from three feet to seven feet and of various modular lengths, for example in six inch increments from six feet to eight feet. When it is desired to employ a table that is greater than eight feet in length, then two or more of the modular units are securely joined together to thereby provide a continuous table top surface of substantially any required length.

The prior art modular work tables were usually fabricated with modular, sturdy, steel, structural supporting systems which could be joined in end to end juxtaposition by employing suitable connecting brackets. A table top working surface for each modular unit was placed upon and supported by the structural members and drilled and countersunk openings were provided for fasteners to secure the table top to the supporting steel sub-structure. The table tops utilized in the prior art tables were countersunk at the drilled openings at the top surface only and no provision was made for reversing the table top should the top surface be damaged by wear or accident. In the case of damage, the presently available table tops are not reversible and the only practical solution now is to discard a top having a damaged top surface and to provide a completely new table top construction.

Additionally, at the common junction between adjacent table top constructions, it is now the common practice to provide a horizontal, transverse, milled slot in each table top end, of suitable configuration to receive therein one half of an interconnecting, metallic, horizontal spline for table top junction reinforcing purposes. The milling of the transverse slots and the need to install a horizontal strengthening spline has resulted in increased construction costs and assembly problems, all of which has added to the initial costs involved in endless work table design, construction and assembly procedures.

SUMMARY OF THE INVENTION

The present invention relates generally to the field of endless industrial work tables, and more particularly, is directed to an improved construction for securing the table tops of adjacent modular table units to the metallic supporting structure.

The present invention relates to a hold-down and connecting bracket particularly designed to secure table tops of industrial work tables to the supporting sub-structure in an improved manner at the interface between the facing ends of adjacent table tops in a modular, elongated, industrial table construction. The bracket includes a pair of similar braces which are specially designed with vertical openings to receive table top fasteners to secure the table tops to the structural support members.

Each brace comprising the bracket is bent to an identical angular configuration to provide a spaced pair of horizontal legs and an integral, spaced pair of vertical legs. The uppermost horizontal leg of each brace contacts directly the undersurface of the table top for securing thereto by suitable fasteners. The lower horizontal leg of each brace is fabricated of length suitable to overfit one-half of the transversely extending end channel of a modular table support construction and is provided with a threaded opening to receive a stabilizer bolt therethrough. The stabilizer bolt advances upwardly and engages the undersurface of the table support channel to thereby apply downwardly directed, table top hold-down forces at the interconnection between the table top fastener and the first horizontal leg of each brace. The adjacent, juxtaposed, vertical legs of each brace are secured together by suitable fasteners which act through aligned openings in the vertical legs. The bracket construction of the present invention provides a simplified, inexpensive and extremely sturdy table top hold-down construction for easily connecting and securing adjacent table tops of a modular work table assembly.

It is therefore an object of the present invention to provide an improved table top connecting bracket of the type set forth.

It is another object of the present invention to provide a novel table top hold-down and connecting bracket comprising a pair of similar, angularly formed braces which are connected to each other and to portions of adjacent table tops for securing the table tops together.

It is another object of the present invention to provide a novel connecting bracket for interconnecting adjacent table tops in a modular table construction which comprises a pair of similar braces, each brace having a first horizontal leg in contact with the undersurface of a table top, a vertical leg connected by a common fastener and a second horizontal leg to mount a stabilizer and hold-down therein.

It is another object of the present invention to provide a novel table top hold-down and connecting bracket including means to secure the bracket to the table top constructions to urge the table tops downwardly relative to the table supporting construction and means to permit either surface of the table tops to face upwardly in a secured position.

It is another object of the present invention to provide a novel table top hold-down and connecting bracket comprising a pair of similar braces, each brace being bent to form a first, upward horizontal leg, a second, lower horizontal leg, a first vertical leg interconnecting the first and second horizontal legs and a second vertical leg depending from the second horizontal leg, the first horizontal legs of each brace being in contact with adjacent table top undersurfaces, the second vertical legs of each bracket being interconnected, and a stabilizer means positioned through each second horizontal leg of a brace to bear against a structural table support member, thereby pulling the table top downwardly relative to the support member.

It is another object of the present invention to provide a novel table top hold-down and connecting bracket that is simple in design, inexpensive in manufacture and trouble-free when in use.

Other objects and a fuller understanding of the invention will be had by referring to the following description and claims of a preferred embodiment thereof, taken in conjunction with the accompanying drawings, wherein like-reference characters refer to similar parts throughout the several reviews and in which:

DESCRIPTION OF THE PREFERRED EMBODIMENT OF THE INVENTION

Figure 1:
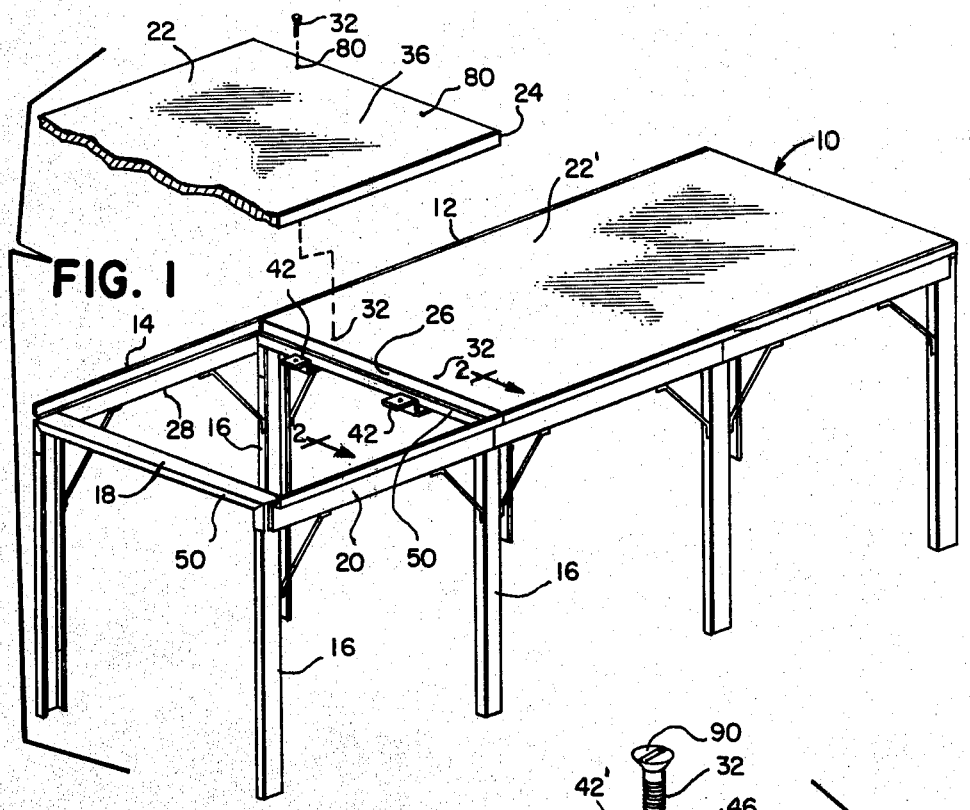
FIG. 1 is a perspective view of a portion of a modular work table, and partly exploded to show particularly the interface between adjacent modular sections.

Although specific terms are used in the following description for the sake of clarity, these terms are intended to refer only to the particular structure of the invention selected for illustration in the drawings and are not intended to define or limit the scope of the invention.

Referring now to the drawings, there is illustrated in FIG. 1 an industrial work table 10 comprising a plurality of adjacent modular units, joined together in end to end juxtaposition, for example a first modular unit 12 and a second modular unit 14. Each modular unit 12, 14 comprises a structural steel sub-structure 28 which preferably comprises a plurality of spaced, vertical legs 16, interconnecting longitudinally aligned edge supports 20 and interconnecting, transverse channels 18. The legs 16, edge supports 20 and transverse channels 18 may be interconnected in any well known, sturdy manner, for example by bolting, spot-welding or riveting. Each modular unit 12, 14 is entirely self-standing and includes a separate supporting sub-structure 28 and a separate, plainer, table top or work surface 22, 22'. Preferably, the table tops 22, 22' are fabricated of non-porous materials and are secured to the sub-structure 28 in a removable manner, for example by employing a plurality of nuts 30 and bolts 32, as hereinafter more fully set forth.

Figure 2:
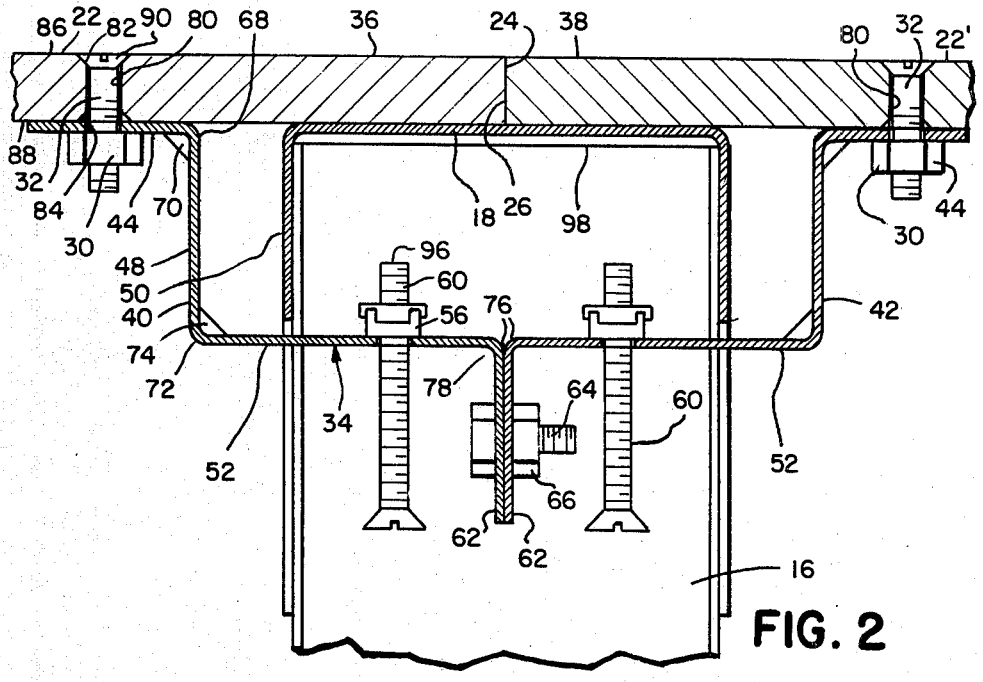
FIG. 2 is an enlarged, cross-sectional view taken along line 2—2 on FIG. 1, looking in the direction of the arrows, showing the stabilizer bolts in a first position.

Referring now to FIG. 2, the composite connecting bracket 34 for securing the table tops 22, 22' to the steel sub-structure 28 is best seen. As illustrated in FIG. 1, preferably two transversely spaced brackets 34 are employed at each junction between the modular units, 12, 14 for securing the facing edges 24, 26 of adjacent table tops 22, 22'. As illustrated, a transverse, channel-shaped support 18 is conventionally positioned at the interface between adjacent modular units 12, 14 to carry the adjacent, respective, lateral ends 36, 38 of table tops 22, 22' of the adjacent first and second modular units 12, 14. The lateral end 36 of the left table top 22 terminates in a transverse, vertical edge 24, which edge is positioned medially over the transverse supporting channel 18. Similarly, the facing, lateral end 38 of the right table top 22' terminates in a facing, vertical edge 26 for abutting directly against the first adjacent edge 24 of the left modular unit 12. The connecting bracket 34 of the present invention is designed particularly to maintain the adjacent table tops 22, 22' in edge abutting relationship and secured to the transverse channel 18 in a manner to prevent relative movement therebetween.

Figure 4:
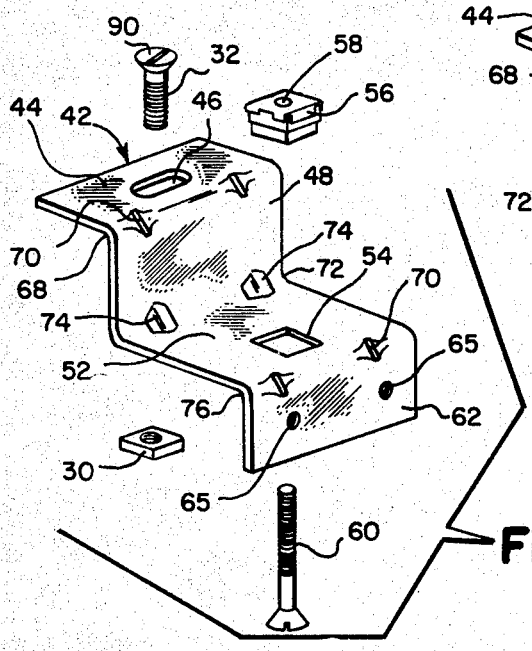
FIG. 4 is an enlarged, exploded, perspective view of a brace illustrated in the embodiment of FIG. 2 and FIG. 3.

As best seen in FIGS. 2 and 4, each bracket 34 comprises a pair of similar, oppositely disposed, interconnected, cooperating braces 40, 42. Each brace 40, 42 is angularly bent to define a plurality of angularly interconnecting, plainar legs, which legs are preferably formed at right angles to one another for ease in manufacture and in joining the parts together. Each brace 40, 42 is bent to define a first, horizontal, table top contacting leg 44, which leg is drilled, punched or otherwise treated to provide an enlongated opening 46 to receive therein a threaded fastener 32 for securing a lateral end 36, 38 of the table tops 22, 22'. The first horizontal leg 44 terminates inwardly in a first, vertical leg 48, which leg extends in length a distance greater than a depending leg 50 of the support channel 18.

The first vertical leg 48 of each brace terminates downwardly in the horizontally bent, second horizontal leg 52 to vertically space the second leg 52 from the first horizontal leg 44 a distance greater than the length of the channel leg 50 for table top securing purposes, as hereinafter more fully set forth. The second horizontal leg 52 is provided with a fastener opening 54 therethrough of configuration to receive and secure therein a Tinnerman nut 56 in known manner. The Tinnerman nut 56 conventionally includes a floating nut with threaded opening 58 to threadedly receive therein a stabilizer bolt 60 for table hold-down purposes. As illustrated, the second horizontal leg 52 terminates inwardly in the downwardly bent, second vertical leg 62. The length of the second horizontal leg 52 is greater than one-half of the width of the channel 18 whereby the pair of braces 40, 42 can be applied over the exterior of the channel legs 50 to releaseably secure the adjacent table top edges 24, 26 to the channel 18.

The second vertical leg 62 of each brace 40, 42 is provided with an aligned, elongated opening or openings 65, through which openings is positioned a connecting bolt 64. The openings 65 may be threaded or a nut 68 may be provided to secure the adjacent braces 40, 42 together beneath and about the transverse channel 18. As illustrated in FIG. 1, preferably a pair of transversely spaced brackets 34 are employed at each transverse junction between adjacent table tops 22, 22'. To provide an extremely sturdy construction at a minimum cost, the transverse junction 68 between the first horizontal leg 44 and the first vertical leg 48 is punched or struck in known manner to provide one or more reinforcing gussets 70. See FIG. 4. Similarly, reinforcing gussets 74 can be provided in the transverse junction 72 and gussets 78 at the transverse junction 76.

Referring now to FIG. 2, it will be observed that each table top lateral end 36, 38 is provided with one or more openings 80 through which a threaded fastener, such as a bolt 32 can be inserted. As illustrated, preferably the fastener 32 includes a flat, enlarged head 90, which head should be positioned below the level of the working surface 86 of each table top 22, 22' to prevent interference with materials (not shown) which are placed upon the table for treatment purposes. In order to permit the table tops 22, 22' to be positioned with either the first working surface 86 facing upwardly or the opposed, second working surface 88 facing upwardly, each bolt opening 80 is provided with countersunk openings 82, 84 at each end, thereby making the surfaces 86, 88 interchangeable for working purposes. Accordingly, should a top surface 86 be damaged or worn during the course of the work, the table top 22, 22' can be simply turned over to expose an undamaged surface 88 to thereby permit further use of the table top without need to actually replace the existing, damaged equipment.

Figure 5:
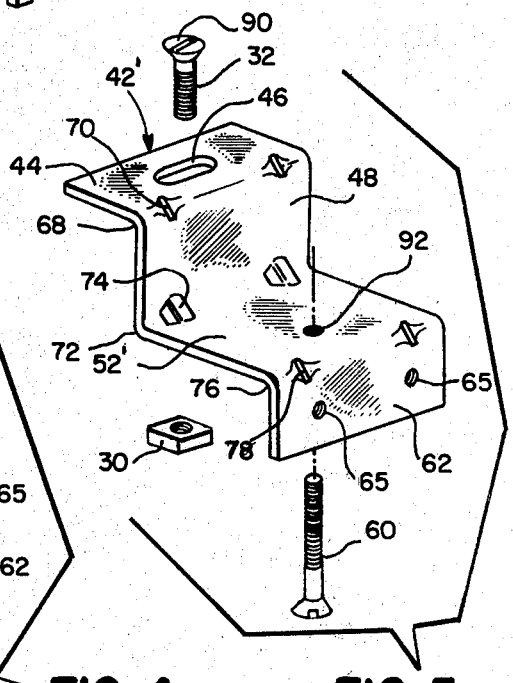
FIG. 5 is an enlarged, exploded, perspective view similar to FIG. 4, showing a modified brace construction.

In the embodiment illustrated in FIG. 5, a modified second horizontal leg 52' of a modified brace 42' is illustrated wherein a threaded opening 92 is provided in lieu of the square opening 54 illustrated in FIG. 4. In this embodiment, the stabilizer bolt 60 can be threadedly engaged directly within the threaded opening 92 to thereby provide an alternate construction for the square opening 54 and Tinnerman nut 56 arrangement of FIG. 4.

In order to use the hold-down and connecting bracket 34 of the present invention, at least a pair of modular units 12, 14 should be placed in end to end juxtaposition as illustrated in FIG. 1. The adjacent table tops 22, 22' should be positioned with their respective facing edges 24, 26 in abutting relationship. See FIG. 2. With the table tops 22, 22' thus positioned, the left and right braces 40, 42 forming a connecting bracket 34 should be securely affixed to the table tops 22, 22' by tightening the bolts 32 and nuts 30 through the aligned openings 80 in the table top and 46 in the brace first horizontal leg 44. By tightening the nuts 30, the bracket braces 40, 42 can thereby readily be secured underside of the table tops. The adjacent, facing respective second vertical legs 62 of the braces 40, 42 should then be placed together as illustrated in FIG. 2 and secured by inserting the bolt 64 through the aligned openings 65. If required, a threaded nut 66 can be employed to conventionally secure the parts together. It will be seen that the bracket 34 is thereby secured in position below and about the transverse table channel 18, but without actually touching the channel 18.

Figure 3:
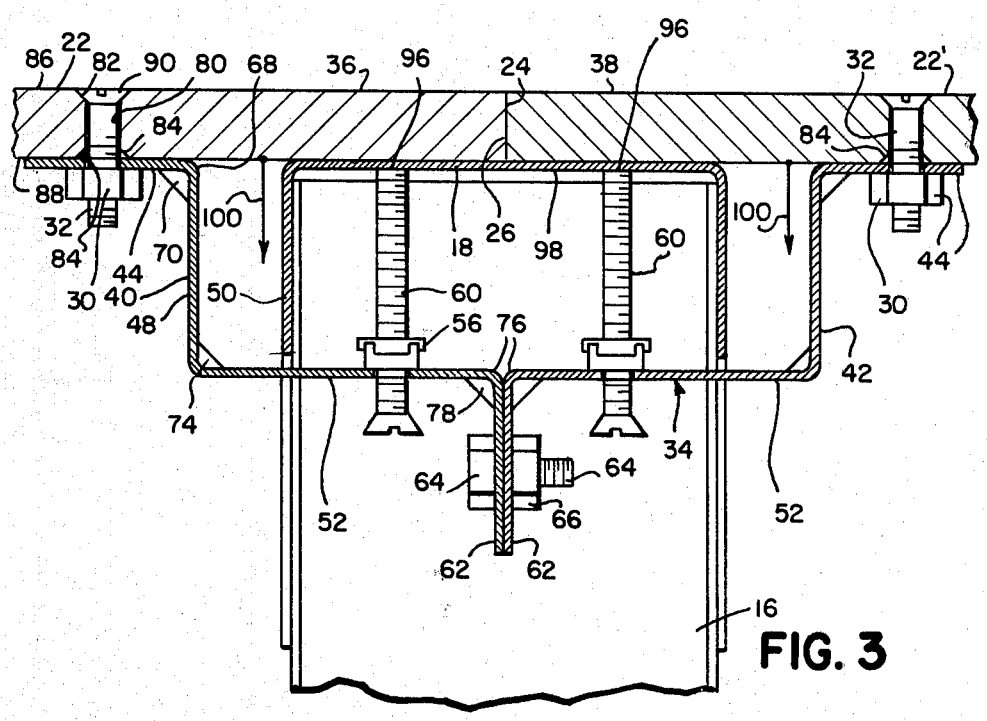
FIG. 3 is an enlarged, cross-sectional view similar to FIG. 2, showing the stabilizer bolts in a secured position.

Referring now to FIG. 3, with the parts arranged as illustrated in FIG. 2, the assembly can then be secured in position by turning the stabilizer bolts 60 from the position shown in FIG. 2 to the position illustrated in FIG. 3 by turning the bolts upwardly. When the ends 96 of the bolts 60 engage upon the undersurface 98 of the transverse channel 18, the upward forces applied at the bolts 60 will tend to push the braces 40, 42 downwardly relative to the channel 18 to thereby apply downwardly directed forces, as indicated by the arrows 100 upon the lateral ends 36, 38 of the table tops 22, 22' to pull the lateral ends into tight engagement upon the web of the channel member 18.

Thus it is seen that the stabilizer bolts 60 function to hold down the lateral ends 36, 38 of the table tops and at the same time, the brace connecting bolt or bolts 64 tend to pull both the adjacent braces 40, 42 and the respective connected ends 36, 38 of the table tops 22, 22' together. The stabilizer bolts 60 can be threadedly upwardly turned either through a threaded opening 92 as illustrated in FIG. 5 or through a threaded opening 58 of a Tinnerman nut 56 as illustrated in FIG. 4. The plurality of gussets 70, 74, 76 act to maintain the respective horizontal and vertical legs comprising the braces 40, 42 in their preferred, ninety degree orientation to thereby prevent any bending or flexing of the braces 40, 42 which might tend to diminish either the vertical or horizontal forces which secure the table tops 22, 22' in locked position over the transverse channel 18.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification but rather only by the scope of the claims appended hereto.

What is claimed is:

1. In a bracket for securing juxtaposed ends of adjacent table tops of a modular table construction wherein the structural interface between adjacent modular units comprises a transverse support, and wherein the ends of the adjacent table tops rest upon the support, the combination of a bracket means comprising a pair of braces to interconnect the table tops ends, the braces each being configured to define a pair of first and second spaced horizontal legs and a pair of first and second vertical legs, the first horizontal leg of one brace being secured to the end of one table top to the left of the transverse table support and the first horizontal leg of the other brace being secured to the end of the other table top to the right of the transverse table support;

means connecting the respective second vertical legs of each of the braces to secure the braces together; and adjustable stabilizer means operative through at least one of the second horizontal legs and adapted to contact the transverse support intermediate the said respective first horizontal legs of the pair of braces, whereby the ends of the adjacent table tops are secured together and vertical movement of the said table top ends relative to the support is discouraged.

2. The bracket of claim 1 wherein the table support comprises a horizontal web having an upper surface, a lower surface and a depending leg and wherein the length of a brace first vertical leg is greater than the length of the table support leg.

3. The bracket of claim 2 wherein the stabilizer means contacts the lower surface of the table support web.

4. The bracket of claim 2 wherein the stabilizer means comprises a threaded member and the one of the second horizontal legs is provided with a third opening, the threaded member being turnable in the third opening to vertically move the threaded member relative to the second horizontal leg.

5. The bracket of claim 4 wherein the horizontal leg third opening is non-circular and wherein a floating nut is retained in the third opening.

6. The bracket of claim 1 wherein the first and second braces do not contact the said transverse support.

7. The bracket of claim 1 wherein the stabilizer means is adapted to apply upwardly directed forces against the underside of the transverse support.

8. The bracket of claim 7 wherein the first horizontal leg of a brace is provided with a first opening and wherein a table top end is provided with a second opening, the first and second openings being aligned, and a fastener through the aligned first and second openings to secure the brace to the table top end.

9. The bracket of claim 8 wherein the brace is adapted to apply downwardly directed forces upon the table top end when the stabilizer means applies upwardly directed forces upon the transverse support.

10. The bracket of claim 9 wherein the second opening extends through the table top from the table top surface to the table bottom surface.

11. The bracket of claim 10 wherein the second opening include countersunk recesses at the table top surface and the table bottom surface, whereby the table top may be positioned upon the transverse support with either surface facing upwardly.

12. The bracket of claim 11 wherein the fastener comprises a threaded bolt and nut.

13. The bracket of claim 1 wherein the braces straddle, but do not contact, the transverse support.

14. The bracket of claim 1 wherein the first and second vertical legs of a brace integrally interconnect with the first and second horizontal legs in angularly bent junctions and strengthening gussets struck into at least some of the bent junctions.

15. The bracket of claim 1 wherein the second horizontal leg of a brace extends in length through a distance that is greater than one-half the width of the transverse support.

* * * * *